United States Patent [19]

Lammert et al.

[11] Patent Number: 4,538,318

[45] Date of Patent: Sep. 3, 1985

[54] PUSH BROOM ASSEMBLY

[75] Inventors: James E. Lammert, Cincinnati, Ohio; Charles E. Nichols, Woodridge; John R. Howard, West Chicago, both of Ill.

[73] Assignee: The Drackett Company, Cincinnati, Ohio

[21] Appl. No.: 566,642

[22] Filed: Dec. 29, 1983

[51] Int. Cl.[3] ..... A46B 15/00; A46B 5/02

[52] U.S. Cl. ..... 15/171; 15/145; 15/146

[58] Field of Search ..... 15/145, 146, 147 C, 15/150, 168, 171, 176, 177, 178, 202

[56] References Cited

U.S. PATENT DOCUMENTS

| | | | |
|---|---|---|---|
| 434,254 | 8/1890 | Davis | 15/150 |
| 1,278,227 | 9/1918 | Schleicher | 15/178 |
| 2,264,736 | 12/1941 | Baker | 15/176 |
| 2,464,509 | 3/1949 | Horwitz | 15/176 |
| 2,835,914 | 5/1958 | Littleton | 15/145 |
| 3,256,048 | 6/1966 | Rea | 15/146 X |
| 3,434,176 | 3/1969 | Cazet | 15/177 |
| 4,317,248 | 3/1982 | Smith | 15/145 |
| 4,384,383 | 5/1983 | Bryant | 15/159 R |
| 4,385,411 | 5/1983 | Clark | 15/160 |

FOREIGN PATENT DOCUMENTS

| | | | |
|---|---|---|---|
| 456600 | 4/1950 | Italy | 15/178 |

*Primary Examiner*—Peter Feldman

*Attorney, Agent, or Firm*—Charles Zeller

[57] ABSTRACT

An improved push broom assembly is disclosed which includes a shroud portion retaining a plurality of bristles thereon and a neck portion angularly protruding from a face of the shroud portion opposite to that which retains the bristles thereon. The neck portion is comprised of two pieces, a first piece integrally formed with the shroud portion and including a recess, and a second piece designed to removably fit into the above noted recess and to combine with the first piece to comprise a completed neck portion. The completed neck portion comprised of the first and second pieces has internal threads which mesh with external threads on a broom handle and further includes exterior threads which mesh with a cap device having interior threads thereon and threaded over the neck portion so as to retain the first and second pieces thereof together.

36 Claims, 5 Drawing Figures

PUSH BROOM ASSEMBLY

BACKGROUND OF THE INVENTION

An improved push broom assembly is disclosed which is easily assembled and disassembled. Brooms, mops and the like made of several detachable elements are well known. In this regard, the following prior art is known to applicant:

U.S. Pat. No. 1,278,227 to Schleicher discloses a broom including a shroud having two halves 4, one of which includes a slot 7 formed by a tab 6 and the other of which includes a tab 8 pivotable in the slot 7. When the two halves 4 are pivoted, the bristles 1 of the broom are clamped between the halves 4. The halves 4 include a combined threaded portion 9 onto which is threaded a cap 10 to thereby maintain the halves 4 in an engaging configuration. The cap 10 has integrally connected thereto a broom handle 12 which as best shown in FIG. 5 includes a pointed end 13 received within a bushing 14 located within the bristles 1. Pins 11 integrally retain the broom handle 12 onto the cap 10.

U.S. Pat. No. 2,464,509 to Horwitz discloses a replacable cleaning unit with a handle therefor which includes two halves 10 and 11 pivoted at reference numeral 15 to allow replacement of the bristle members 4 as best shown in FIG. 8. When the members 10 and 11 are pivoted together, half cylindrical upward projections 16 thereof combine to form a cylindrical portion over which a sleeve 17 is reciprocated to thereby retain the halves 10 and 11 together in compressing engagement with the broom refill 4. The broom handle 2 is as best shown in FIG. 7 a hollow rod which is permanently attached to the half member 10.

U.S. Pat. No. 2,835,914 to Littleton discloses a mop having a detachable head therefor consisting of mop strands 12 held by a strap element 15. The strap element 15 includes as best shown in FIG. 2 a narrow strap section 17 and the strap member 15 is made of a resilient bendable material. After the mop strands 12 are placed over the strap section 17, the element 15 is folded in half so that the portions 18 are side by side to thereby form a threaded neck including threads 19 composed of the half sections 18. As best shown in FIG. 5, a cap-like ferrule 16 is threaded over the threads 19 on the halves 18 to thereby retain the element 15 in the configuration shown. Thereafter, a handle 10 including threads 11 may be threaded into the internal threads 21 formed on the inside portion of the members 18.

U.S. Pat. No. 3,434,176 to Cazet discloses a shell mounted broom including a pair of halves which are assembled to form a sleeve 3 and a skirt 2. The skirt 2 includes means 10 and 11 to retain therein a bundle of bristles 1 while the neck portion 3 is retained in a closely fitting orientation by a sleeve poriton 13 which fits over the neck portion 3. Additional retaining means including elements *7a, 7b,* 8 and 9 as shown in FIG. 2, for example, also facilitate the retention of the broom together.

U.S. Pat. No. 4,317,248 to Smith discloses a hand tool having a quick release handle including a first member 22 which holds a portion 34 of the tool 10 between it and the handle 14, and a second member 20 which holds the first member 22 in position. The member 20 includes a mounting arm 64 about which the member 20 pivots when mounted on the handle 14.

U.S. Pat. No. 4,384,383 to Bryant discloses a push type broom including a shroud 20 into which are assembled bristles 32. A handle 12 is obliquely threaded into the lower portion of the bore 40 by its threads 17 and is thereby fastened to the shroud neck portion 34. No provision for making the neck portion 34 of a plurality of parts is disclosed therein.

U.S. Pat. No. 4,385,411 to Clark discloses a broom including a handle receiving portion 14 having a bore 17 for receipt of a handle 12. There is no disclosure in this patent of a neck portion made of a plurality of disassembleable parts.

SUMMARY OF THE INVENTION

The improved push broom assembly of the present invention overcomes the disadvantages and complexities of the prior art patents discussed above by providing a broom with the following features:

(a) a shroud portion designed to hold a plurality of bristles which face away from the face of the shroud on which they are mounted;

(b) the shroud portion has on its opposite face from the face on which the bristles are mounted a composite neck assembly extending away from this opposite face at an oblique angle to the plane of the shroud;

(c) the neck portion includes a first piece integrally formed with the shroud and including an elongated recess therein. This first piece includes at a portion thereof most adjacent the shroud a semi-cylindrical hollow portion including internal threads and a portion thereof most remote from the shroud including a threaded semi-cylindrical outer surface. The second piece of the neck portion fits into the above described recess and includes respective external and internal threads of the same pitch and dimension as the respective external and internal threads of the first piece and which when assembled into the recess mesh with the respective external and internal threads of the first piece to form a substantially cylindrical extremity including circumferential external threads and a substantially cylindrical recess including circumferential interior threads;

(d) a cap member is provided which includes internal tapered threads designed to mesh with the external threads of the neck portion and which is threaded over these external threads to thereby retain the first piece and second piece in assembly;

(e) a broom handle is provided which includes at an extreme end thereof external threads which mesh with the internal threads of the neck portion;

(f) above the cylindrical threaded recess is a further cylindrical recess formed by the first and second pieces which includes two longitudinal ribs, one formed on the first piece and one formed on the second piece. These ribs engage the broom handle and are biased there against when the cap tapered threads are threaded over the neck exterior threads to aid in retaining the handle therein;

(g) with this assembly, if the broom handle is broken in such a manner that the broken portion is captured completely within the neck portion, this portion of the broom handle may easily be retrieved through unthreading of the cap portion and disassembly of the second piece from the first piece to thereby gain access to and enable removal of the piece of the broken broom handle captured therein.

Accordingly, it is a first object of the present invention to provide an improved push broom assembly.

It is a further object of the present invention to provide an improved push broom assembly wherein the handle thereof is removable from the bristle containing portion thereof.

It is a yet further object of the present invention to provide the bristle containing portion of the improved push broom assembly with an oblique neck made of a plurality of parts which fit together to form a composite neck assembly.

It is a still further object of the present invention to provide the neck portion with composite external threads sized to receive the internal threads of a cap-like neck retaining portion.

It is a yet further object of the present invention to provide the composite neck portion with internal threads designed to threadably receive an exteriorly threaded portion of the broom handle of the present invention.

It is a still further object of the present invention to provide an improved push broom assembly which is designed to enable disassembly thereof so that if a piece of a broken broom handle is lodged inside the neck portion, it may be removed and the broom handle may thereby be replaced.

These and other objects, advantages and modifications of the present invention will become evident from the following detailed description of the preferred embodiments thereof when taken in conjunction with the appended drawing figures.

SPECIFIC DESCRIPTION OF THE PREFERRED EMBODIMENT

Figure 1:
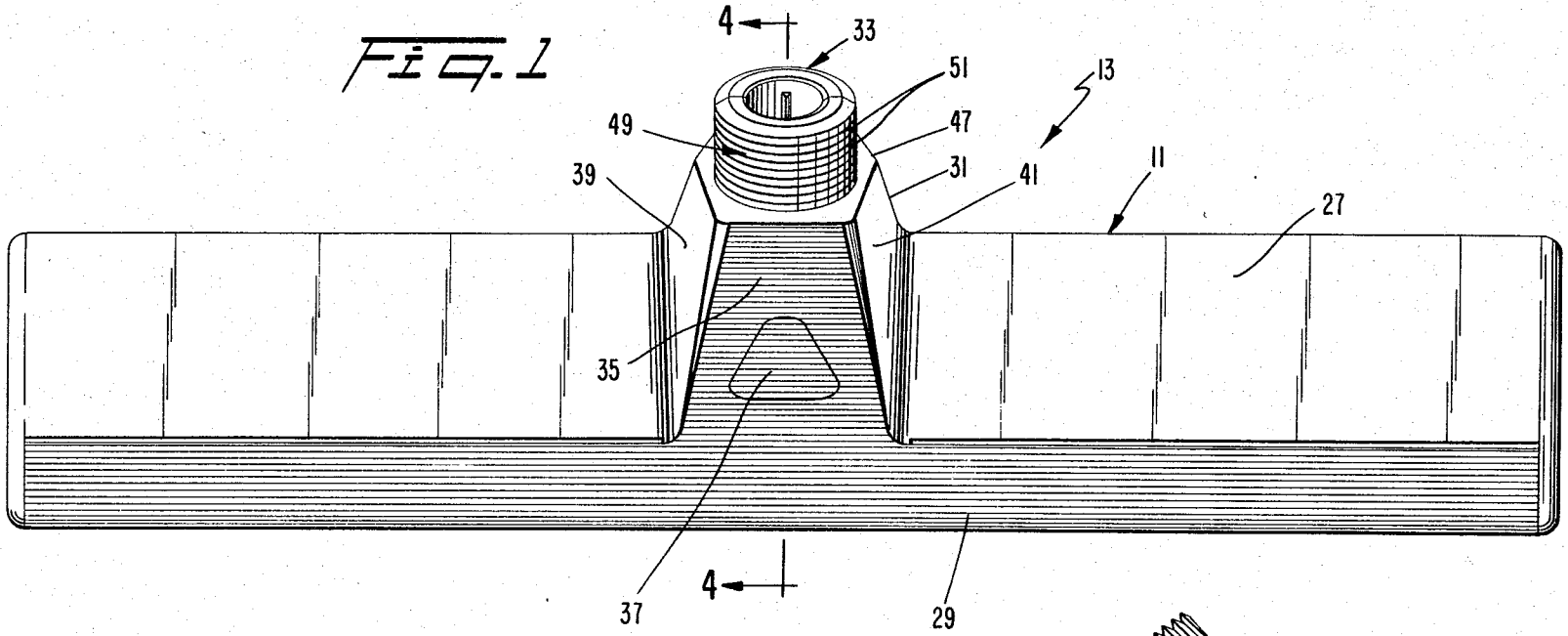
FIG. 1 shows a perspective view of the improved push broom assembly with the cap and handle thereof removed to show detail.

With reference to FIGS. 1-5, the improved push broom assembly 10 of the present invention is seen to include a shroud 11, a neck assembly 13, a cap 15, bristles 17 and an elongated handle 19. The shroud 11 includes a bottom surface 21 onto which the bristles 17 are mounted by any suitable means and further includes a front surface 23, a back surface 25, a top surface 27 from which the neck assembly 13 protrudes and a beveled surface 29 which connects the front surface 23 with the top surface 27.

Figure 2:
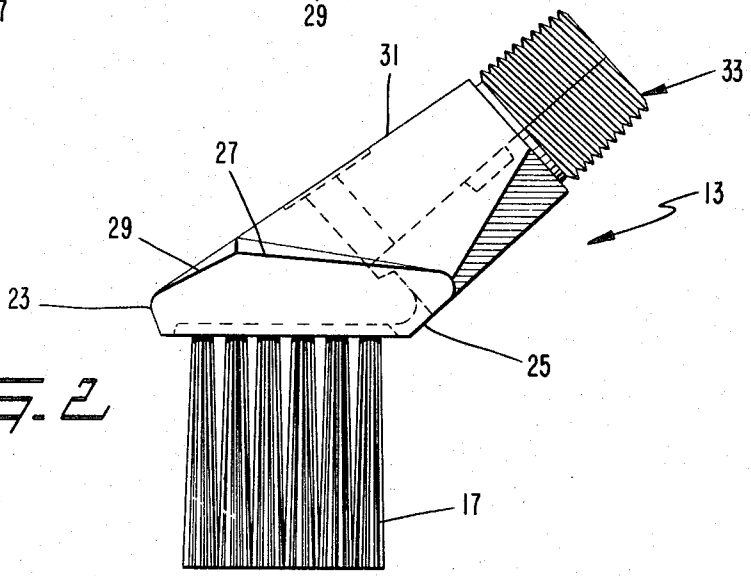
FIG. 2 shows a side view of the invention with the cap and handle thereof removed to show detail.
Figure 3:
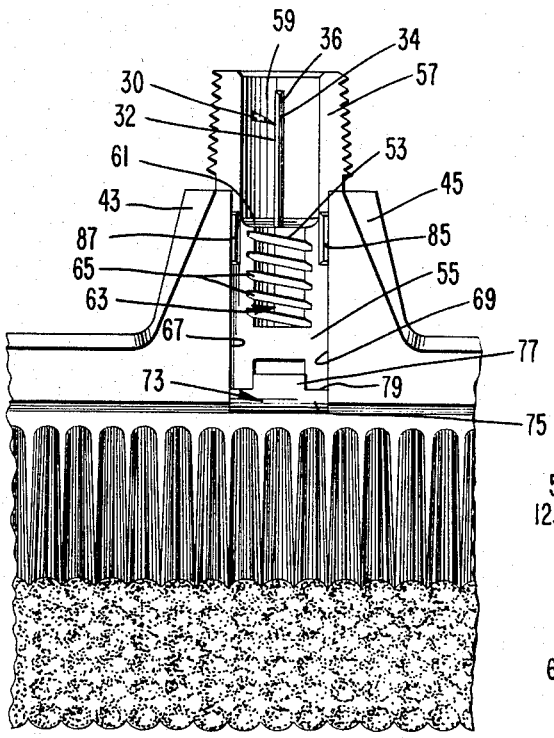
FIG. 3 shows a view from the back of the invention with the cap, handle and removable neck piece thereof removed to show detail.

The neck assembly 13 is comprised of two portions, a neck portion 31 which is formed, in the preferred embodiment, integrally with the shroud portion 11 and preferably extends outwardly from the face 27 thereof at an oblique angle thereto as best shown in FIG. 2. The neck assembly 13 further includes a removable neck piece 33 best shown in FIGS. 4 and 5. The neck portion 31 includes a front face 35 on which an indicia 37 may be provided, if desired, side faces 39 and 41, rear faces 43 and 45, and top face 47. A substantially semi-cylindrical protruding portion 49 extends outwardly from the face 47 and includes tapered screw-type threads 51 on its exterior surface. As best seen in FIG. 3, the surfaces 43 and 45 of the neck portion 13 are separated by a recess 53 which includes a planar face 55 extending throughout its length, which planar face 55 is continued by a planar face 57 in the same plane as the planar face 55 and defining the rear-most extension of the protruding member 49. As is seen in FIGS. 1 and 3 in particular, the protruding member 49 includes an interior wall portion 59 which is substantially semi-cylindrical in shape and includes a bottom wall 61 which connects with a further substantially semi-cylindrical recess 63 formed in the recess 53, which recess 63 includes threads 65 in the walls thereof. The planar surfaces 55 and 57 are connected with the surfaces 43 and 45 of the neck assembly 13 by respective walls 67 and 69. As best seen in FIG. 3, the interior wall portion 59 has protruding inwardly therefrom a longitudinal rib 30 which is substantially triangular in cross-section including two elongated faces 32, 34 intersecting at an elongated line 36. This rib 30 is for a purpose to be described hereinafter.

Figure 4:
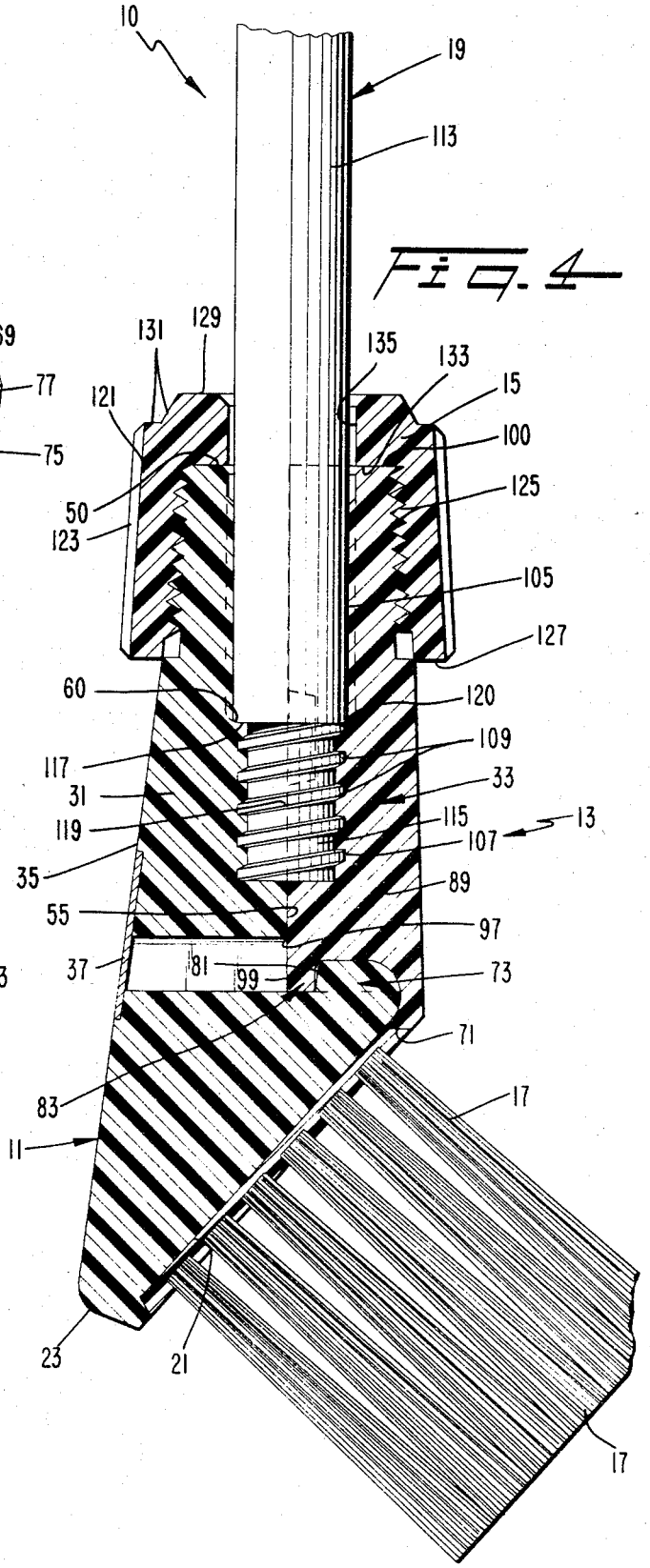
FIG. 4 shows a cross-sectional view of the invention along the line 4—4 of FIG. 1 with all parts assembled, including a handle.

As best seen in FIG. 4, the bristles 17 extend outwardly from the surface 21 which is in fact recessed into the shroud portion 11 with the recessing being defined by a shoulder 71. At the back portion of the shroud 11, and formed as an upward continuation of the recessed surface 21, is a tab-like member 73 which includes as best shown in FIG. 3 a lower wide portion 75, a portion 77 extending upwardly from the wide portion 75 and a shoulder 79 connecting the portions 75 and 77 together. As best seen in FIGS. 2 and 4, the tab 73 includes a front surface 81 which is spaced from the planar wall 55 so as to define therebetween a recess 83 for a purpose to be described hereinafter. A pair of ear-like members 85 and 87 are provided within the recess 53 for a purpose to be described hereinafter. The ear-like member 85 extends outwardly away from both the wall 69 and the planar surface 55 whereas the ear-like member 87 extends outwardly from both the wall 67 and the planar surface 55.

Figure 5:
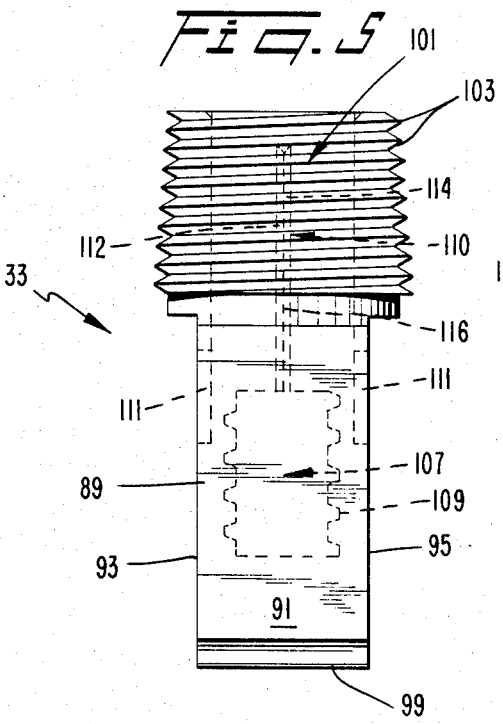
FIG. 5 shows a view from one side of the removable neck piece.

With particular reference to FIGS. 4 and 5, the removable neck piece 33 is seen to include a main body portion 89 having a substantially flat face 91 and substantially flat sides 93 and 95 both of which terminate in a planar face 97 which continues throughout the length of the removable neck piece 33. Extending downwardly from the main body portion 89 is a tab-like portion 99 which is designed to fit within the recess 83 of the shroud 11. Extending upwardly from the main body poriton 89 of the removable neck piece 33 is a semicylindrical portion 101 which includes exterior tapered threads 103 thereon. As best shown in FIG. 4, the top portion 101 of the removable neck piece 33 includes a semi-cylindrical recess 105 therein which, when the removable neck piece 33 is assembled to the shroud 11, forms with the recess 59 thereof a substantially cylindrical recess. As best shown in FIG. 5, the recess 105 has protruding inwardly therefrom an elongated longitudinal rib 110 which, like the above described rib 30, is substantially triangular in cross-section and includes two elongated faces 112, 114 intersecting at an elongated line 116. When the neck piece 33 is assembled to shroud 11, the cylindrical recess formed by the respective semi-cylindrical recesses 59 and 105 has protruding therein respective ribs 30 and 110 at substantially diametric opposition to one another for a purpose to be described hereinafter. Further, the main body portion 89 of the removable neck piece 33 includes a further substantially semi-cylindrical recess 107 which is recessed inwardly from the planar face 97 and includes screw threads 109 therein. As best shown in FIG. 4, when the removable neck piece 33 is assembled to the shroud 11, the substantially semi-cylindrical recess 107 forms with the substantially semi-cylindrical recess 63 of the shroud 11 a substantially cylindrical recess including continuous screw threads therein formed by the respective screw threads 109, 65. Similarly, the external screw threads 51 and 103, in assembly, form a continuous screw thread as well. The removable neck piece 33 further includes a pair of recesses 111 which extend inwardly from the planar surface 97 and which interfit with the protrusions 85 and 87 which extend outwardly from the planar surfaces 55 and 57 to thereby aid in orienting the removable neck piece 33 with the shroud 11.

Referring now to FIG. 4, the handle 19 is seen to include an elongated substantially cylindrical portion 113, a short substantially cylindrical portion 115 of smaller diameter than the elongated portion 113, and a shoulder 117 connecting the substantially cylindrical portions 113 and 115 together. The substantially cylindrical portion 115 includes on the exterior surface thereof screw threads 119 complimentary to the screw threads formed by the screw thread portions 65 and 109.

Still referring to FIG. 4, the cap 15 is seen to include a major wall portion 121 including exterior serrations 123 for gripping purposes and interior threads 125 designed to mesh with the exterior threads formed by thread portions 51 and 103 of the respective shroud 11 and removable neck portion 33. The cap 15 further includes a bottom shoulder 127, a top shoulder 129, and an annular portion 131 of V-shaped cross-section which connects the top surface 129 with the serrated outer walls 123. In the interior of the cap 15, the tapered screw threads 125 terminate at an annular wall surface 133 which defines the innermost extension of a substantially cylindrical hole in the cap 15 which is defined at its outermost portion by the top surface 129. The substantially cylindrical hole 135 is dimensioned to be slightly larger in diameter than the outer diameter of the portion 113 of the handle 19 for a purpose to be described hereinafter. As shown in FIG. 4, if desired, the serrated wall surface 123 may be tapered so that its diameter increases as one travels from the top wall 129 to the bottom wall 127, however, if desired, the serrated wall surface 123 may be substantially cylindrical.

Now, the operation of the improved push broom assembly of the present invention will now be described. With specific reference to FIG. 4, the removable neck portion 33 is assembled to the shroud 11 by inserting the tab 99 into the recess 83 at an angle, and thereafter pivoting the removable neck portion 33 into the position shown in FIG. 4. In this position, the tab-like members 85 and 87 will protrude into the recesses 111 formed in the removable neck portion 33 to thereby ensure that the removable neck portion 33 is properly aligned. As assembled, the planar faces 55 and 57 on the shroud 11 will abut the planar face 97 on the removable neck portion 33. As assembled, the thread portions 65 and 109 will combine to form a single continuous thread while the thread portions 51 and 103 will also combine to form a single continuous thread.

After the removable neck portion 33 has been assembled to the shroud 11, the cap 15 is threaded over the threads formed by thread portions 51 and 103 to thereby retain the removable neck portion in its assembled configuration. For this purpose, the cap 15 includes tapered threads 125 of a pitch complimentary to the threads formed by thread portions 51, 103 which thereby enables the cap 15 to be threaded thereover. In the preferred embodiment, the cap 15 is threaded over the neck assembly 13, only partially, with the surface 133 thereof spaced from the top surface of the neck assembly 13 formed by top surface 50 of the protruding portion 49 and top surface 100 on the removable neck portion 33. After the cap 15 has been partially threaded over the neck assembly 13 to thereby retain the removable neck portion 33 therewith, the handle 19 may then be assembled. The handle 19 is inserted through the substantially cylindrical opening 135 in the cap 15 and the small substantially cylindrical portion 115 thereof is threaded into the threads formed by complimentary thread portions 65 and 109. For this purpose, the small cylindrical portion 115 of the handle 19 includes external threads 119. In the preferred embodiment, the handle 19 is threaded into the recess formed by the shroud 11 and removable neck portion 33 until the shoulder 117 on the handle 19 abuts against a shoulder formed by a respective shoulder portions 60 and 120 on the respective shroud 11 and removable neck portion 33. After the handle 19 has been tightly threaded therein, the cap 15 is further threaded onto the neck assembly with the taper of cap threads 125 causing the above described ribs 30 and 110 to be pressed inwardly to tightly engage the handle cylindrical portion 113 and possibly embed themselves into the portion 113 (depending upon the respective materials of the ribs 30, 110 and the handle portion 113) to thereby prevent the handle 19 from being unscrewed from the neck portion's internal threads. Thus, if for some reason, the handle 19 should break with the broken piece located entirely within the neck assembly 13, such broken piece of the handle 19 may easily be retrieved by unthreading the cap 15, pivoting the removable neck portion 33 away from protrusions 85 and 87 and recess 83 to thereby remove the removable neck portion 33 and thence retrieve the broken portion of the handle 19. Subsequently, the neck assembly 13 may be reassembled as explained above, with a new handle may be assembled thereto also as explained above.

The improved push broom assembly of the present invention has been explained above in terms of a specific embodiment thereof. It should be clear, however, that various modifications and/or changes may be made in the form, construction and arrangement of the above described parts without departing from the spirit and scope of the invention and without sacrificing any of its advantages. For example, the removable neck portion 33 may be, instead, pivoted to the recess 83 so that it would be permanently attached thereto. Further, the pitch of the various disclosed threads of the cap 15 and neck assembly 13 may be made at any desired configuration without departing from the teachings of the invention. Further, the neck assembly 13 may, if desired, protrude from the top surface 27 perpendicularly as desired or at any other desirable angle. These are merely examples of the various changes and modifications that may be made to the present invention without departing from the intended scope thereof. As such, it is to be clearly understood, that it is intended that the invention as disclosed herein only be limited by the scope of the appended claims.

I claim:

1. An improved push broom assembly comprising:

(a) a unitary shroud portion having at least one bristle mounted thereon;

(b) a neck portion extending away from said shroud portion and including a first piece formed integrally with said shroud portion and a second piece removably interfitting with said first piece, said first piece defining a recess into which said second piece interfits;

(c) a handle insertable into a cavity formed between said first piece and said second piece and removably retainable therein; and (d) means for releasably retaining said first piece and said second piece in interfitting engagement.

2. The invention of claim 1, wherein said shroud portion includes a first shroud face having a plurality of bristles mounted thereon and a second shroud face on a side of said shroud portion substantially opposite from said first shroud face, said neck portion protruding from said second shroud face.

3. The invention of claim 2, wherein said neck portion protrudes from said second shroud face at an oblique angle thereto.

4. The invention of claim 2, wherein said shroud portion has an outer surface and said first shroud face is recessed inwardly from said outer surface.

5. The invention of claim 1, wherein said neck portion first piece comprises:

(a) a mound-like protrusion extending away from said shroud portion; and (b) a first threaded portion formed on top of said mound-like protrusion, said first threaded portion having first thread means on an exterior surface thereof.

6. The invention of claim 5, wherein said neck portion first piece further includes a first substantially planar face extending substantially the entire extent of said mound-like protrusion and said first threaded portion, and wherein said neck portion first piece further includes second and third substantially planar faces, each of which is substantially perpendicular to said first substantially planar face and each of which extends substantially the entire extent of said mound-like protrusion, said first, second and third substantially planar faces defining said recess.

7. The invention of claim 6, wherein said first threaded portion is substantially semi-cylindrical in shape and includes a first substantially semi-cylindrical depression therein which is recessed inwardly from said first substantially planar face.

8. The invention of claim 7, wherein a second substantially semi-cylindrical depression is formed adjacent said first substantially semi-cylindrical depression and is also recessed inwardly from said first substantially planar face, said second substantially semi-cylindrical depression having second thread means extending radially outwardly therefrom.

9. The invention of claim 8, wherein a first tab extends upwardly from said shroud portion a small distance into said recess, said first tab being spaced from said first substantially planar face to define therebetween a gap.

10. The invention of claim 9, wherein said second piece comprises:

(a) a second threaded portion including third thread means on an exterior surface thereof;

(b) a fourth substantially planar face extending substantially the entire extent of said second piece;

(c) a third substantially semi-cylindrical depression recessed inwardly from said fourth substantially planar face and being substantially concentric with said third thread means; and (d) a fourth substantially semi-cylindrical depression formed adjacent said third substantially semi-cylindrical depression and also recessed inwardly from said fourth substantially planar face, said fourth substantially semi-cylindrical depression having fourth thread means extending radially outwardly therefrom.

11. The invention of claim 10, wherein said second piece further includes a second tab sized to loosely fit into said gap whereby when said second piece is assembled to said first piece, said second tab pivotably fits into said gap, said first thread means and said third thread means combine to form a first continuous thread, said second thread means and said fourth thread means combine to form a second continuous thread, said first and third substantially semi-cylindrical depressions combine to form a first substantially cylindrical chamber and said second and fourth substantially semi-cylindrical depressions combine to form a second substantially cylindrical chamber with said second continuous thread extending radially outwardly therefrom, said first and second chambers forming said cavity.

12. The invention of cliam 11, wherein said handle includes a threaded end including exterior threads complimentary with said second continuous thread and a peripheral portion adjacent said threaded end dimensioned to closely fit into said first chamber.

13. The invention of claim 12, wherein said means for releasably retaining said first piece and said second piece in interfitting engagement comprises a cap including interior threads complimentary with said first continuous thread and a top portion with a hole therein sized to allow said handle to pass therethrough, said cap being threaded over said first continuous thread to retain said first piece and second piece in interfitting engagement.

14. The invention of claim 13, wherein said cap, said second tab and said gap interact to maintain said first substantially planar face in abutment with said fourth substantially planar face.

15. The invention of claim 14, wherein said first substantially semi-cylindrical depression has a first elongated rib extending inwardly therefrom and said second substantially semi-cylindrical depression has a second elongated rib extending inwardly therefrom, said ribs engaging said handle to prevent said handle from being loosened within said cavity when said cap has been tightened over said first and second pieces.

16. The invention of claim 1, wherein said means for releasably retaining comprises a cap which overlies adjacent portions of said first and second pieces, said cap further including a hole through which said handle may protrude.

17. The invention of claim 16, wherein said cap has interior threads and said adjacent portions of said first and second pieces each have a thread component which combine with one another to form threads complimentary with said interior threads of said cap.

18. The invention of claim 16, wherein said cap may be removed to enable disassembly of said second piece from said first piece to thereby allow removal from said cavity of a broken off piece of said handle located entirely within said cavity.

19. An improved push broom assembly comprising:

(a) unitary shroud means;
(b) neck means including a cavity therein;
(c) handle means releasably retained in said cavity;
(d) said neck means including a first portion that is formed as a part of said shroud means, said first portion having a recess, and a second portion removably inserted into said recess in the first portion, said first and said second portions forming said cavity; and
(e) whereby, removal of said second piece from said first piece allows removal of said handle means from said cavity.

20. The invention of claim 19, wherein said handle means and said cavity have complimentary screw threads and said handle means may also be removed from said cavity by rotating said handle means with respect to said cavity in a predetermined direction.

21. The invention of claim 1, wherein said neck portion first piece is a major portion of said neck portion.

22. The invention of claim 6, wherein said mound-like protrusion is a major portion of said neck portion.

23. The invention of claim 20, wherein said neck portion first piece is a major portion of said neck portion.

24. An improved push broom assembly comprising:
(a) a shroud portion;
(b) a neck assembly extending away from the shroud portion and comprising a first neck portion including a first collet portion, the first neck portion being a major portion of said neck assembly, said first neck portion having a recess, and a second neck portion including a second collet portion, the second neck portion being a removable neck piece removably interfitting essentially wholly into the recess, said collet portions defining a collet;
(c) a handle insertable into a cavity in the collet;
(d) means cooperating with the collet for releasably retaining the first neck portion and the second neck portion in interfitting engagement; and
(e) means anchoring at least one tuft of bristles to the shroud portion.

25. The invention of claim 24, wherein the shroud portion is unitarily formed.

26. The invention of claim 25, wherein the neck portion first piece is a mound-like member formed integrally with the shroud portion, said first collet portion formed on top of said mound-like member.

27. The invention of claim 24, wherein said shroud portion includes a first shroud face having a plurality of tufts of bristles mounted thereon and a second shroud face on a side substantially opposite the first shroud face, the first neck portion extending from the second shroud face.

28. The invention of claim 26, wherein the mound-like member extends obliquely from the second shroud face.

29. The invention of claim 26, wherein the exterior surface of each collet portion is provided with thread means, forming thereby a first continuous thread on said collet.

30. The invention of claim 29, wherein the first neck portion further includes a first substantially planar face extending substantially the extent of the mound-like member and the first collet portion, and second and third substantially planar faces, each of which is substantially perpendicular to the first substantially planar face and each of which extends substantially the entire extent of said mound-like member, the first, second and third substantially planar faces defining the recess, and wherein the neck portion second piece further includes a fourth substantially planar face extending substantially the entire extent of said second piece, fifth and sixth substantially planar faces, each of which extends substantially the entire extent of said second piece excluding the second collet portion and each of which is substantially perpendicular to the fourth substantially planar face, and a seventh face opposite the fourth substantially planar face, whereby, in assembly, the first and fourth substantially planar faces are in abutment.

31. The invention of claim 30, wherein the collet first portion includes a substantially semicylindrical depression that is recessed inwardly from said first substantially planar face, and the collet second portion includes a substantially semicylindrical depression that is recessed inwardly from said fourth substantially planar face, said depressions in each of said collet portions forming the cavity in the collet.

32. The invention of claim 31, wherein said neck portion first piece further includes another substantially semicylindrical depression recessed inwardly from said first substantially planar face and which is formed adjacent the first collet portion semicylindrical depression, and wherein said neck portion second piece further includes another substantially semicylindrical depression that is recessed inwardly from said fourth substantially planar face and which is formed adjacent the second collet portion semicylindrical depression.

33. The invention of claim 32, wherein said means cooperating with the collet for releasably retaining said first piece and said second piece in interfitting engagement comprises a cap including interior threads complimentary with said first continuous thread and a top portion with a hole therein sized to allow said handle to pass therethrough, said cap being threaded over said first continuous thread to retain said first piece and second piece in interfitting engagement.

34. The invention of claim 33, wherein each of said inwardly recessed depressions in said first and fourth substantially planar faces and adjacent the collect portion depressions has thread means, whereby, in assembly, said thread means form a second continuous thread, and wherein the handle includes a threaded end including exterior threads complimentary with said second continuous thread.

35. The invention of claim 32, wherein a first tab extends upwardly from said shroud portion a small distance into said recess, said first tab being spaced from said first substantially planar face to define therebetween a gap, and wherein said second piece further includes a second tab sized to loosely fit into said gap, whereby when said second piece is assembled to said first piece, said second tab fits into said gap.

36. The invention of claim 30, wherein the first and fourth substantially planar faces have at least one complimentary pair of protrusion and recess means to provide proper interfitment of said neck portion second piece in said neck portion first piece recess.

* * * * *